US008949014B2

(12) United States Patent
Bateman et al.

(10) Patent No.: US 8,949,014 B2
(45) Date of Patent: Feb. 3, 2015

(54) SYSTEMS AND METHODS FOR PRESENTATION OF PROBABLE WAKE TURBULENCE

(75) Inventors: Charles Donald Bateman, Bellevue, WA (US); Robert A. Champion, Mukilteo, WA (US); Ruy C. Brandao, Redmond, WA (US)

(73) Assignee: Honeywell International Inc., Morristown, NJ (US)

( * ) Notice: Subject to any disclaimer, the term of this patent is extended or adjusted under 35 U.S.C. 154(b) by 190 days.

(21) Appl. No.: 13/564,526

(22) Filed: Aug. 1, 2012

(65) Prior Publication Data

US 2014/0039785 A1 Feb. 6, 2014

(51) Int. Cl.
*G08B 23/00* (2006.01)

(52) U.S. Cl.
USPC ..... 701/301; 342/41

(58) Field of Classification Search
USPC ..... 701/301, 9, 14; 244/75.1, 180, 181; 340/970, 968, 949, 961; 342/29, 41
See application file for complete search history.

(56) References Cited

U.S. PATENT DOCUMENTS

| | | | | |
|---|---|---|---|---|
| 6,133,867 | A * | 10/2000 | Eberwine et al. | 342/29 |
| 6,177,888 | B1 * | 1/2001 | Cabot et al. | 340/968 |
| 6,683,541 | B2 | 1/2004 | Staggs et al. | |
| 6,703,945 | B2 | 3/2004 | Kuntman et al. | |
| 7,411,519 | B1 | 8/2008 | Kuntman et al. | |
| 7,463,955 | B1 | 12/2008 | Robinson et al. | |
| 7,471,995 | B1 | 12/2008 | Robinson | |
| 8,131,407 | B1 | 3/2012 | Robinson | |
| 8,135,500 | B1 | 3/2012 | Robinson | |
| 2002/0024652 | A1 | 2/2002 | Ooga | |

* cited by examiner

*Primary Examiner* — Dalena Tran
(74) *Attorney, Agent, or Firm* — Ingrassia Fisher & Lorenz, P.C.

(57) ABSTRACT

Systems and methods for improving the presentation of wake turbulence information. A processor located on an ownship receives position, heading and type information of another aircraft and position and heading information of the ownship. The processor determines if a possible wake condition exists from the other aircraft based on at least a portion of the received information and at least one predefined threshold and generates a wake icon if a wake condition is determined to exist. The wake condition exists when the ownship's altitude is below a first threshold altitude and above a second threshold altitude, wherein the first and second threshold altitudes are based on the other aircraft's altitude.

17 Claims, 4 Drawing Sheets

SYSTEMS AND METHODS FOR PRESENTATION OF PROBABLE WAKE TURBULENCE

BACKGROUND OF THE INVENTION

An unexpected encounter with wake turbulence can result in possible loss of control, with possible concomitant injury to crew and passengers, typically during all phases of flight. These encounters occur many times every year.

In general, the smaller the following aircraft, the larger the disturbance when experiencing a fly through wake situation. There have been fatal accidents in the past, which later resulted in greater aircraft separation standards air traffic authorities.

The display of a possible wake turbulence ahead would be a great tool for the pilot. U.S. Pat. No. 7,411,519 granted to Honeywell on Jun. 2, 2002 describes one method to create such a cockpit display.

SUMMARY OF THE INVENTION

The present invention provides systems and methods for improving the presentation of possible wake turbulence information. A processor located on an ownship receives position, heading and type information of another aircraft and position and heading information of the ownship. The processor determines if a wake condition exists from the other aircraft based on at least a portion of the received information and at least one predefined threshold and generates a wake icon if the wake condition is determined to exist. The wake condition exists when the ownship's altitude is below a first threshold altitude and above a second threshold altitude, wherein the first and second threshold altitudes are based on the other aircraft's altitude.

In one aspect of the invention, the wake icon includes two or more segments. One of the segments is presented in at least one first color, intensity, pattern, or flash rate and another of the segments is presented in at least one second color, intensity, pattern, or flash rate.

In another aspect of the invention, the processor receives from system(s) on the ownship wind information, which uses that information to determine length of at least one segment.

In still another aspect of the invention, the length of the segments have one or more predefined values based on at least one of time or distance.

In yet another aspect of the invention, the processor determines flight path of the other aircraft based on at least a portion of the received information and receives flight path of the ownship. The wake condition is determined to exist if the other aircraft's flight path intersects the flight path of the ownship when viewed from a plan view.

An objective of the present invention is to give the pilot awareness to only possible pertinent wake turbulence, but to also keep to a minimum clutter on the display of non pertinent wake turbulence. If a pilot sees a wake icon or hears a wake alert, the pilot can contact air traffic control (ATC) or divert from current path.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
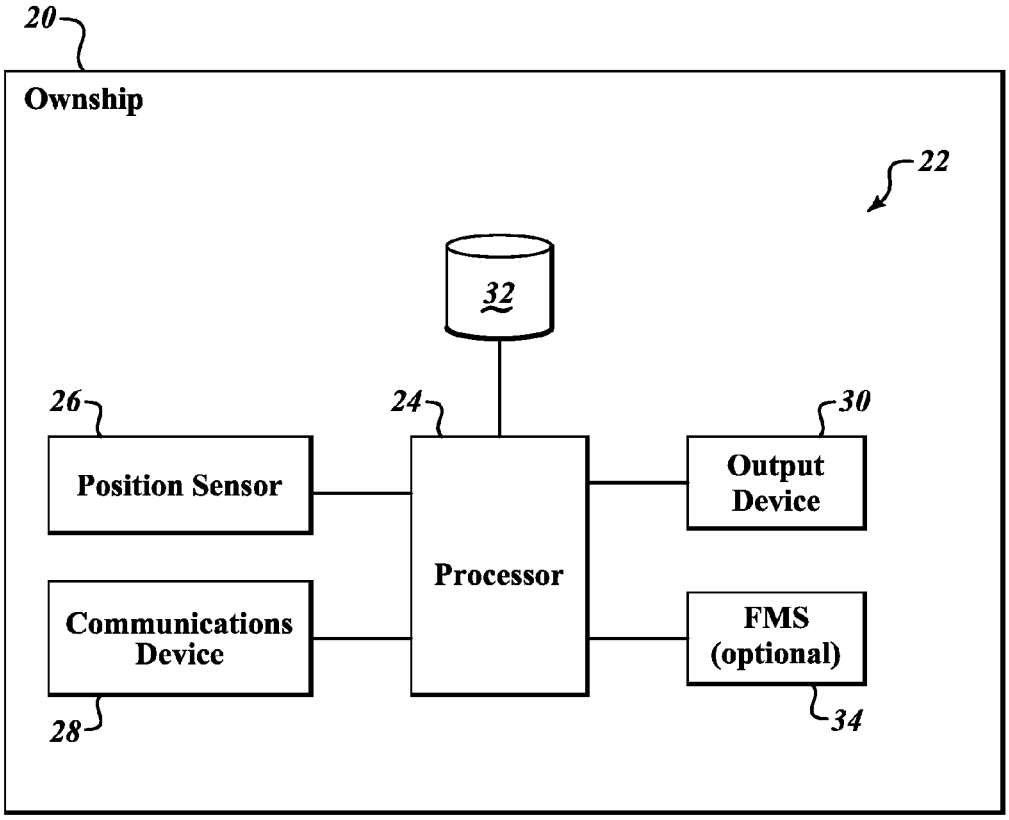
FIG. 1 is a block diagram of an exemplary system formed in accordance with an embodiment of the present invention.

FIG. 1 shows a system 22 located on an aircraft 20 for presenting only possible wake turbulence on a display. The system 22 includes a processor 24 that is in signal communication with a position sensor 26, a communication device 28, an output device 30 and/or a memory device 32.

The processor 24 receives ownship position/track information from the position sensor 28 and other aircraft information via the communication device 28 and/or memory device 32. Using the received information, the processor 24 determines if the ownship is at or below an aircraft ahead, then outputs a probable-wake image for the other aircraft. If the ownship is below a lower threshold relative to the aircraft ahead, the no probable-wake image is outputted.

In one embodiment, the processor 24 presents the probable wake of the other aircraft on the output device 30, if the projected own flight path or other aircraft is determined to intersect at the same altitude or below the other aircraft's altitude. In other words, if the flight paths were viewed in a plan view, they would intersect.

In one embodiment, the algorithms are contained in an existing traffic collision-avoidance system (TCAS) computer. ADS-B IN track and altitude of each other aircraft, even those behind the ownship 20 in cruise, are supplied to the TCAS computer (the processor 24).

Figure 2:
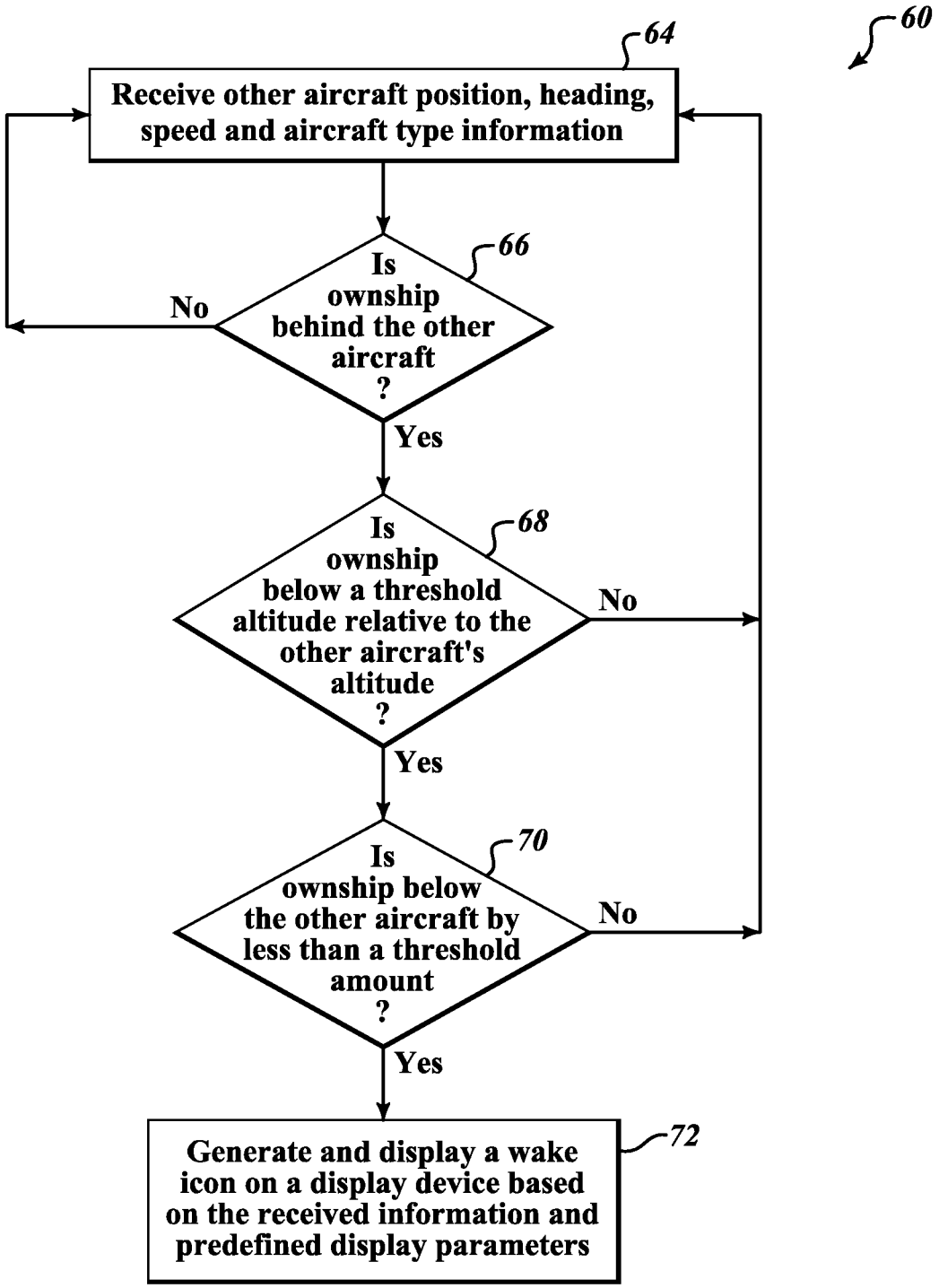
FIG. 2 is a flowchart of an exemplary process performed by the system shown in FIG. 1.

FIG. 2 shows an exemplary process 60 performed by the system 22 shown in FIG. 1. First at block 64, the processor 24 receives other aircraft position, heading, speed and type information from the communication device 28. Next at a decision block 66, the processor 24 determines if the ownship 20 is behind the other aircraft based on the received other aircraft information and ownship information received from local components (e.g., the position sensor 26, the memory 32, the FMS 34). If the ownship 20 is not determined to be behind the other aircraft, then the process 60 returns to block 64. If the ownship 20 is determined to be behind the other aircraft, then the processor 24 determines, at decision block 68, if the ownship 20 is below a threshold altitude relative to the other aircraft's altitude (e.g., at other aircraft's altitude). If the ownship 20 is not below a threshold altitude relative to the other aircraft's altitude, then the process 60 returns to block 64. If the ownship 20 is below the threshold altitude relative to the other aircraft's altitude, then the processor 24 determines, at decision block 70, if the ownship 20 is below the other aircraft by less than a threshold amount (e.g., 500 feet). If the ownship 20 is below the other aircraft by less than the threshold amount, then at block 72, the processor 24 generates a wake icon based on the received information and predefined display parameters. The wake icon is displayed on the output device (i.e., display) 30.

Figure 3:
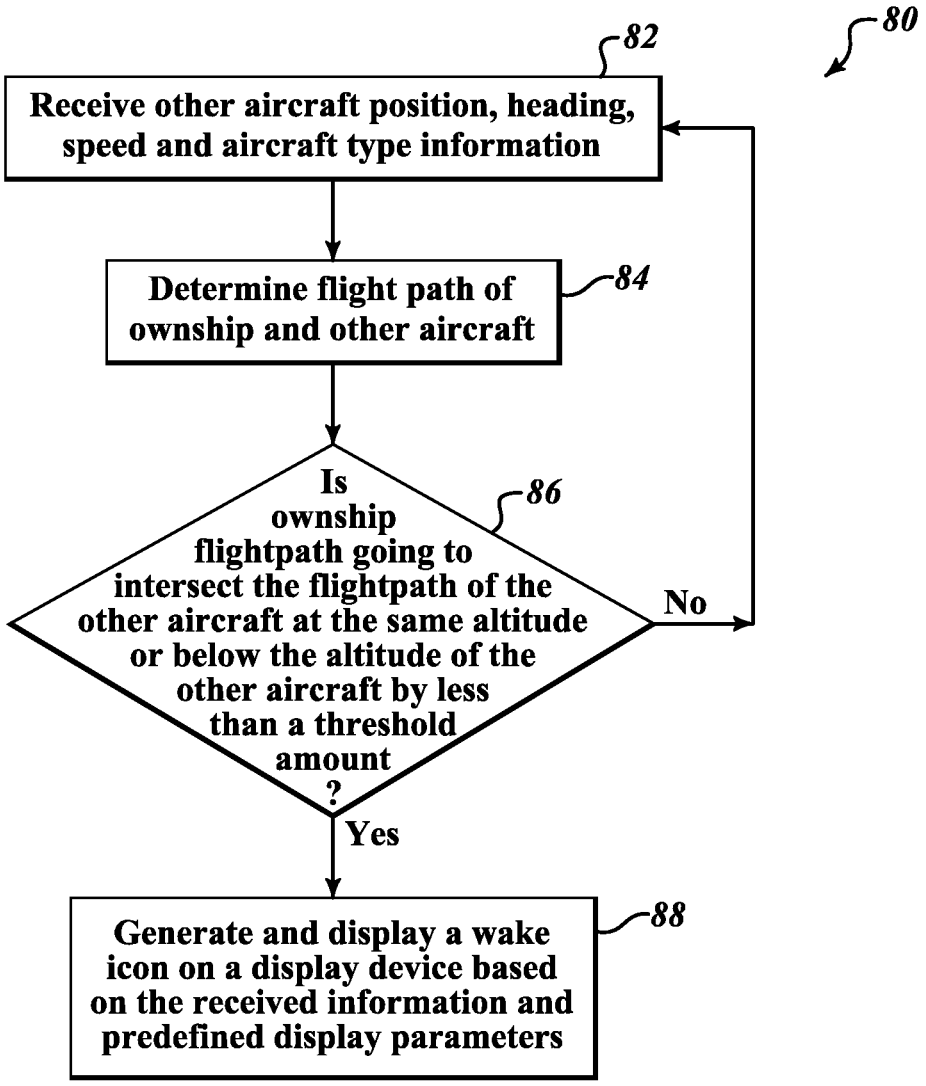
FIG. 3 shows a screenshot of an exemplary cockpit display that shows possible wake turbulence of other aircraft.

FIG. 3 shows an exemplary process 80 performed by the system 22 shown in FIG. 1. First at block 82, the processor 24 receives other aircraft position, heading, speed and type information from the communication device 28. Next at a decision block 84, the processor 24 determines the flight path of the ownship 20 and the other aircraft based on the received other aircraft information and ownship information received from local components (e.g., the position sensor 26, the memory 32, the FMS 34). Next, at a decision block 86, the processor 24 determines if the flight path of the ownship 20 is going to intersect the flight path of the other aircraft at approximately the same altitude and/or below the altitude of the other aircraft by less than a threshold amount. If the flight path of the ownship 20 is not going to intersect the flight path of the other aircraft at the same altitude and/or below the altitude of the other aircraft by less than the threshold amount, then the process 80 returns to block 82. If the flight path of the ownship 20 is going to intersect the flight path of the other aircraft at the same altitude and/or below the altitude of the other aircraft by less than the threshold amount, then at block 88, the processor 24 generates a wake icon based on the received information and predefined display parameters. The wake icon is displayed on the output device (i.e., display) 30.

In one embodiment, the ownship 20 receives wind information from the FMS 34 or from other equipment. The processor 24 uses the wind information to identify position of a wake-turbulence icon relative to an associated other aircraft symbol.

In one embodiment, the other aircraft files and application program are contained within or performed by a separate ADS-B IN receiver that drives a navigation-type display.

In one embodiment, if the aircraft is above own aircraft by 2,000 feet or greater, the possible wake is not shown.

Figure 4:
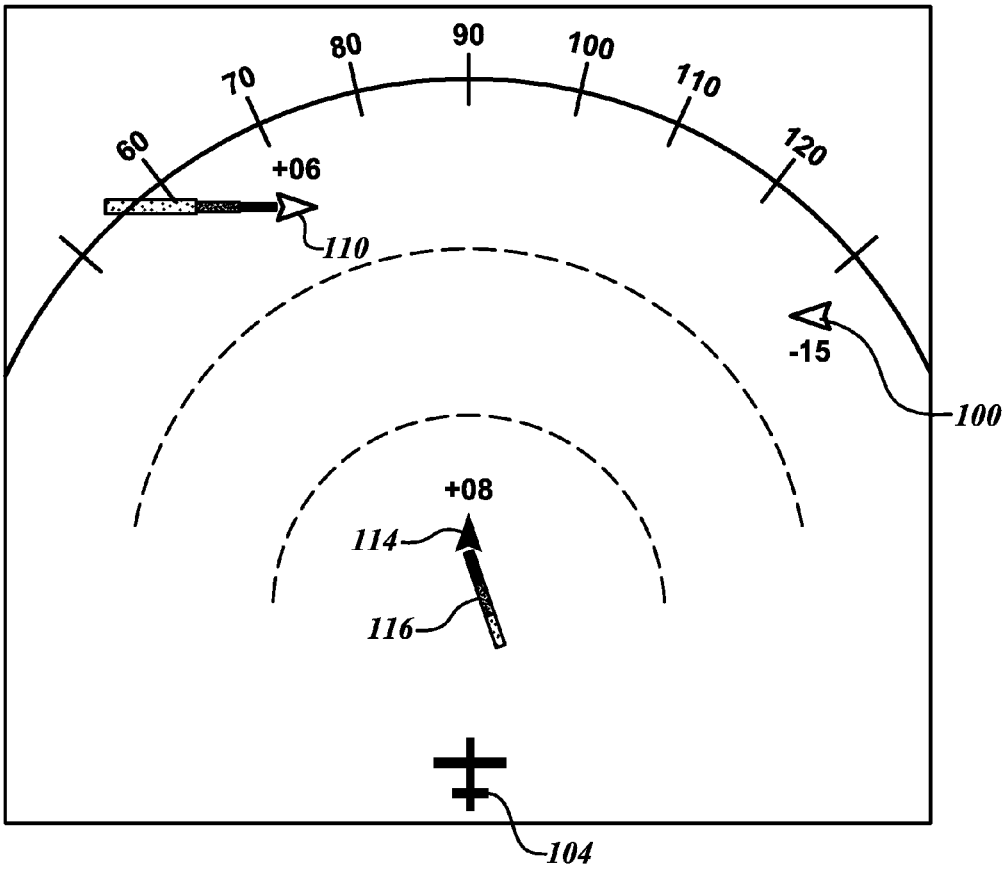
FIG. 4 is a screen shot of an exemplary display generated by the system shown in FIG. 1.

FIG. 4 shows an exemplary navigation/radar display 100. The display 100 presents processor-generated symbols 110, 114 that represent other aircraft that are located in front of the ownship (as indicated by aircraft symbol 104). The display 100 also shows symbols 116 that identify a predicted wake possible turbulence for the aircraft associated with the attached aircraft symbol 114. In this example, only wake symbols are shown for the aircraft symbols 110, 114 because the associated aircraft meet one or more of the required conditions as described in FIGS. 2 and 3.

In one embodiment, the wake symbol (e.g., 116) includes three segments; other number of segments may be used. The first segment located immediately behind the aircraft symbol is considered the most dangerous and is presented in a first color, intensity, pattern and/or flash rate. The other segments are presented at different colors, intensities, patterns and/or flash rates than the first segment. The segments represent a distance (e.g., 2 nautical miles (NM)), a distance associated with a predetermined time value (e.g., 5 minutes for entire wake symbol) or a dynamically determined time value. The distance for one segment maybe different than for other segments. The dynamically determined time value is based on relative speed of the aircraft (other and ownship), wind speed, wind direction and/or altitude.

In one embodiment, the received wind value is used for the generation of the wake symbol. For example, the second and third segments of the wake symbol 116 are at angles different than the flight path of the associated aircraft, because either a crosswind has been identified thus causing the predicted wake to be displaced or the aircraft was just previous in a turn.

In one embodiment, if the ownship flies into the indentified possible wake turbulence of another aircraft, then the processor 24 outputs an alert to the pilot via the output device, such as an audio, visual or tactile output. In another embodiment, air traffic control (ATC) is advised of the situation where one aircraft is flying into the possible wake of another aircraft.

In one embodiment, after alert(s) about flying into the indentified possible wake turbulence have been outputted and the ownship is not longer flying in the indentified possible wake turbulence, the processor 24 outputs information that the aircraft has cleared the indentified possible wake turbulence.

In one embodiment, if a comparison between the aircraft type information of the ownship and the other aircraft indicate a certain condition (i.e., the other aircraft is much smaller than the ownship), then the wake image is suppressed (not displayed).

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A method comprising:

at a processor located on an ownship, receiving position and heading of another aircraft;

receiving position and heading information of the ownship;

determining if a wake condition exists from the other aircraft based on at least a portion of the received information and at least one predefined threshold; and generating a wake icon if the wake condition is determined to exist, the wake icon comprising two or more line segments, each line segment representing a distance between the ownship and the another aircraft, one of the line segments presented in at least one first color, intensity, pattern, or flash rate and another of the line segments presented in at least one second color, intensity, pattern, or flash rate.

2. The method of claim 1, wherein determining comprises determining the wake condition exists when the ownship's altitude is below a first threshold altitude and above a second threshold altitude, wherein the first and second threshold altitudes are based on the other aircraft's altitude.

3. The method of claim 2, further comprising at the processor receiving type information of the other aircraft, wherein determining if the wake condition exists is further based on the received type information.

4. The method of claim 3, further comprising receiving wind information at the processor.

5. The method of claim 4, wherein generating comprises basing length of at least one line segment on wind information.

6. The method of claim 1, wherein each of the line segments is represented by a displayed length.

7. The method of claim 1, further comprising:

at the processor, determining flight path of the other aircraft based on at least a portion of the received information; and receiving flight path of the ownship, wherein determining if the wake condition exists comprises determining if the other aircraft's flight path intersects the flight path of the ownship when viewed from a plan view.

8. A system located on an ownship, the system comprising:

a position sensor configured to determine position and heading information of the ownship;

a communication device configured to receive position and heading information of another aircraft;

a processor configured to determine if a wake condition exists from the other aircraft based on at least a portion of the received information and at least one predefined threshold; and generate a wake icon if the wake condition is determined to exist; and an output device configured to output the generated wake icon, the wake icon comprising two or more line segments, each line segment representing a distance between the ownship and the another aircraft, one of the line segments presented in at least one first color, intensity, pattern, or flash rate and another of the line segments presented in at least one second color, intensity, pattern, or flash rate.

9. The system of claim 8, wherein the processor determines the wake condition exists when the ownship's altitude is below a first threshold altitude and above a second threshold altitude, wherein the first and second threshold altitudes are based on the other aircraft's altitude.

10. The system of claim 9, wherein the processor further receives type information of the other aircraft and determines if the wake condition exists further based on the received type information.

11. The system of claim 10, further comprising a device configured to determine wind information.

12. The system of claim 11, wherein the processor determines a length of at least one line segment based on the wind information.

13. The system of claim 10, wherein the lengths of the line segments are based on at least one of time and distance.

14. The system of claim 8, further comprising:

a device configured to determine flight path of the ownship, wherein the processor determines flight path of the other aircraft based on at least a portion of the received information and determines the wake condition exists determining if the other aircraft's flight path intersects the flight path of the ownship when viewed from a plan view.

15. A system comprising:

a means for receiving at least position and heading information of another aircraft;

a means for receiving position and heading information of the ownship;

a means for determining if a wake condition exists from the other aircraft based on at least a portion of the received information and at least one predefined threshold; and a means for generating a wake icon if the wake condition is determined to exist, the wake icon comprising two or more line segments, each line segment representing a distance between the ownship and the another aircraft, one of the line segments presented in at least one first color, intensity, pattern, or flash rate and another of the line segments presented in at least one second color, intensity, pattern, or flash rate.

16. The system of claim 15, wherein the means for determining determines the wake condition exists when the ownship's altitude is below a first threshold altitude and above a second threshold altitude, wherein the first and second threshold altitudes are based on the other aircraft's altitude.

17. The system of claim 15, further comprising:

a means for determining flight path of the other aircraft based on at least a portion of the received information; and a means for receiving flight path of the ownship, wherein the means for determining if the wake condition exists determines if the other aircraft's flight path intersects the flight path of the ownship when viewed from a plan view.

* * * * *